US007125092B2

(12) United States Patent
Ouchi

(10) Patent No.: US 7,125,092 B2
(45) Date of Patent: Oct. 24, 2006

(54) PRINT SYSTEM CAPABLE OF INHIBITING DEFORMATION OF PRINTING PAPER DUE TO DRYING OF INK AND PRINT METHOD THEREOF

(75) Inventor: Tetsuya Ouchi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 267 days.

(21) Appl. No.: 10/769,897

(22) Filed: Feb. 3, 2004

(65) Prior Publication Data

US 2004/0212649 A1 Oct. 28, 2004

(30) Foreign Application Priority Data

Feb. 4, 2003 (JP) ..... 2003-027675

(51) Int. Cl.
*B41J 29/38* (2006.01)
*B41J 29/393* (2006.01)

(52) U.S. Cl. ..... 347/16; 347/19

(58) Field of Classification Search ..... 347/16, 347/19

See application file for complete search history.

(56) References Cited

U.S. PATENT DOCUMENTS 5,757,407 A 5/1998 Rezanka
6,406,110 B1 * 6/2002 Ahne et al. ..... 347/8
2002/0196300 A1 12/2002 Takahashi et al.

FOREIGN PATENT DOCUMENTS

| | | | |
|---|---|---|---|
| JP | A 60-236776 | | 11/1985 |
| JP | A 4-32442 | | 2/1992 |
| JP | A 9-52397 | | 2/1997 |
| JP | A 10-67148 | | 3/1998 |
| JP | 2002-113853 | * | 4/2002 |
| JP | A 2002-113853 | | 4/2002 |

* cited by examiner

*Primary Examiner*—Lamson Nguyen
*Assistant Examiner*—Jannelle M. Lebrón
(74) *Attorney, Agent, or Firm*—Oliff & Berridge, PLC

(57) ABSTRACT

A technique is provided which sufficiently inhibits deformation of printing paper resulting from drying of ink on the paper. When the amount of ink ejected during which the front end of the printing paper is moved, after entered into a counter area facing a print head, to a determination point exceeds the ink amount "enough to cause deformation" of the printing paper, the front end of the printing paper is moved from the determination point to a hold position located downstream thereof and left there for a predetermined time. Thus, the shape of the front portion of the printing paper is maintained, and the deformation of the printing paper due to the drying of ink is prevented.

26 Claims, 13 Drawing Sheets

PRINT SYSTEM CAPABLE OF INHIBITING DEFORMATION OF PRINTING PAPER DUE TO DRYING OF INK AND PRINT METHOD THEREOF

BACKGROUND OF THE INVENTION i) Technical Field of the Invention

This invention relates to a print system that can inhibit deformation of printing paper resulting from drying of ink on the paper, and a print method for the print system.

ii) Description of the Related Art

At the present day, a printer is widely known which ejects ink onto a surface of a printing paper while the paper is being transferred from a feed position to a discharge position for printing (so-called ink jet printer).

In this type of printer, the printing paper is often curled up gently if there is much ink; that is, much moisture, ejected onto the surface of the printing paper. In this case, the printing paper may not be inserted between a pair of discharge rollers properly, causing a paper jam inside the printer.

For this reason various techniques to prevent such curling of the printing paper have been proposed these days. For instance, the Unexamined Patent Publication No. 9-62397 discloses a technique of slowing down the transfer speed of the printing paper when a paper jam is detected in a state that the amount of ink ejected by a print head has become more than a predetermined amount. This technique allows moisture on the printing paper to be reduced when there is too much ink ejected on the surface of the printing paper. By slowing down the transfer speed of the printing paper, more time is secured for drying the ink on the printing paper and thus the curling of the printing paper can be inhibited.

However, the aforementioned technique merely slows down the transfer speed of the printing paper. The shape of the printing paper cannot be maintained during the time the ink on the paper is being dried. Consequently, the printing paper is sometimes deformed partially while the ink is being dried.

If such deformation occurs immediately after the printing onto the printing paper is started, that is, on the front portion of the printing paper, there is a fear that a portion of the printing paper may come close to or come into contact with the print head and the printing quality may be deteriorated. Furthermore, if large deformation occurs in the printing paper with a high water absorption rate, the printing paper may be torn by the scan of the print head or may cause a paper jam for the reason that the printing paper is not inserted between the discharge rollers properly.

SUMMARY OF THE INVENTION

One object of the present invention is to provide a technique that sufficiently inhibits deformation of printing paper following the drying of ink on the printing paper.

In order to attain the above object, a print system of the present invention comprises a print head that ejects ink, an upstream transfer device, a downstream transfer device and a print instruction device. The upstream transfer device is provided in a feed path extending from a feed position to a counter area facing the print head. The upstream transfer device transfers a recording medium along the feed path. The downstream transfer device is provided in a discharge path extending from the counter area to a discharge position. The downstream transfer device transfers the recording medium along the discharge path. The print instruction device provides instructions for the upstream transfer device or the downstream transfer device to transfer the recording media and for the print head to eject ink, alternately based on print data, so that a predetermined image is printed onto the recording medium. The print data represents an ink ejection pattern of the predetermined image.

The print system further comprises an ink amount measurement device and an ink amount determination device. The ink amount measurement device measures the amount of ink ejected from the print head and stores the amount as a measurement value. The ink amount determination device determines whether the measurement value in the ink amount measurement device exceeds a preset value when the recording medium is transferred by the upstream transfer device and the front end of the recording medium is moved to a first position. The downstream transfer device is comprised of a drive roller and a driven roller. The recording medium is passed through between the drive roller and the driven roller.

When it is determined by the ink amount determination device that the measurement value exceeds the preset value, the print instruction device discontinues the instructions based on the print data, and instructs the upstream transfer device to transfer the recording medium from the first position to the downstream transfer means. After the recording medium is transferred to the downstream transfer device by the instructions of the print instruction device and held between the drive roller and the driven roller, the print instruction device further instructs the upstream transfer device to transfer the recording medium to a second position. The second position is the position where the printing should be performed after the printing at the first position is completed. The second position is located at least downstream of the first position. After the front end of the recording medium is moved to the second position, the instructions based on the print data are resumed.

According to the above print system, when the amount of ink ejected on the front portion of the recording medium exceeds the predetermined amount, the image printing based on the print data is discontinued. Then, after the recording medium is transferred from the first position to the downstream transfer device, the front end of the recording medium is moved to the second position, and the image printing based on the print data is continued. Here, the recording medium is transferred to the downstream transfer device and the front portion of the recording medium is held between the drive roller and the driven roller composing the downstream transfer device. Consequently, the front portion of the printing paper is kept straightened by being caught by both upstream and downstream transfer mechanisms and the evenness on the front portion is maintained. Thus, deformation of the recording medium due to the drying of ink can be inhibited.

The print data shows an ink ejection pattern from the print head. The print head ejects ink according to this pattern.

The ink amount measurement device is the device that measures the amount of ink ejected from the print head. The ink amount measurement device may be designed to measure the amount of ink based on the number of ink drops ejected from the print head.

Particularly, the ink amount measurement device can be designed to comprise a drop counter which counts the number of times the print instruction device instructs the print head to eject an ink drop, or a dot counter which counts the number of times of ink drop ejection which can be specified by the ejection pattern indicated in the print data, for example.

The above mentioned print instruction device may be designed to instruct the upstream transfer device to transfer the recording medium to the second position immediately after the recording medium is transferred to the downstream transfer device and the front end of the recording medium is held between the drive roller and the driven roller. However, the recording medium may be left for a predetermined time in a state that the front end of the recording medium is being held between the drive roller and the driven roller.

The print system constituted with this preference can reliably prevent the deformation of the printing paper due to the drying of ink.

The "predetermined time" in this constitution may be interpreted as the time assumed to be required for drying the ink on the recording medium or the time required till a portion of the printing paper which is deformed due to the moisture of ink is recovered to its original state as the ink is being dried.

In the aforementioned upstream transfer device, when the transfer direction of the recording medium is reversed, there is a fear that an error may occur in the transfer amount owing to the structure of the transfer mechanism. That is, if the recording medium is returned directly to the first position from the downstream transfer device, the position where the image printing should be resumed is misaligned, resulting in deterioration of the print quality.

Accordingly, it is preferable that the print system of the present invention is designed as follows. That is, after the recording medium is transferred to the downstream transfer device and left there for a while, the print instruction device instructs the upstream transfer device to transfer the recording medium from the downstream transfer device to a third position. The third position is a position spaced apart from the first position by a predetermined distance on the side of the feed position. When the front end of the recording medium is moved to the third position, the print instruction device instructs the upstream transfer device to transfer the recording medium from the third position to the first position. After the front end of the recording medium is moved to the first position, the instructions based on the print data are resumed.

According to the print system constituted as above, the front end of the recording medium is moved to the third position on the side of the feed position beyond the first position, after the recording medium is transferred to the downstream transfer device and left for a while. Then, the recording medium is returned to the first position from the third position and the image printing based on the print data is resumed. Since the transfer direction of the recording medium is not reversed at the first position, misalignment of the position where the image printing should be resumed is avoided, and high print quality is achieved.

The aforementioned ink amount determination device determines whether the measurement value in the ink amount measurement device exceeds a preset value. The ink amount determination device is designed to determine whether the ink amount ejected from the print head has reached to the sufficient amount which is assumed to make the front portion of the recording medium easy to deform, for example.

The ink amount determination device may also be designed to change the preset value used for the determination of the measurement value corresponding to parameters of the recording medium.

Particularly, the print system of the present invention preferably comprises a recording medium parameter acquisition device that obtains parameter data representing parameters of the recording medium from the outside. The ink amount determination device modifies the preset value used for the determination of the measurement value according to the parameters shown as the parameter data obtained by the recording medium parameter acquisition device.

The recording medium parameter acquisition device with this preference may be designed to receive the parameter data from other apparatus which can be communicated with the present print system for data exchange, for example. The parameters may be obtained by way of a user input as well.

In order to obtain the parameters from a user input, it is preferable that the present print system particularly comprises a parameter input device that allows a user to input parameters of the recording medium, for example. The recording medium parameter acquisition device obtains the parameters inputted from the parameter input device as the parameter data.

The aforementioned recording medium parameter acquisition device may be designed to obtain data representing the size of the recording medium as a parameter of the recording medium.

According to the print system constituted as above, the data representing the size of the recording medium can be obtained as the parameter data. The ink amount determination device can change the preset value used for the determination of the measurement value according to the size of the recording medium.

It is preferable that the recording medium parameter acquisition device obtains data representing the thickness of the recording medium.

The print system constituted as such can obtain the data representing the thickness of the recording medium as the parameter data. Thus, the time during which the recording medium is held between the rollers can be changed depending on the thickness of the recording medium.

It is preferable that the recording medium parameter acquisition device obtains data representing the material of the recording medium.

The print system constituted as such can obtain the data representing the material of the recording medium as the parameter data. Thus, the ink amount determination device can be switched to between execution and non-execution of the determination depending on the material of the recording medium.

It is preferable that the print system of the present invention further comprises a switching device that switches the operation mode of the printing system according to the instructions from the outside. There are two modes to be switched to; a suspension mode and a regular mode. In the suspension mode, the instructions based on the print data from the print instruction device are interrupted according to the determination result of the ink amount determination device. In the regular mode, the instructions based on the print data are not interrupted regardless of the determination result of the ink amount determination device.

The mode switching device in this constitution is preferably designed to switch the operation mode according to the input instructions from the outside of the print system, for example. If the print system comprises an operation portion that receives a user input, the operation mode may be switched depending on the user input.

The print system described so far can be either a single apparatus (printer) or a combination of a plurality of apparatus.

For example, a printer and a terminal apparatus which can be communicated to each other for data exchange may constitute the print system of the present invention. In this case, the printer comprises the print head, upstream transfer device, downstream transfer device and print instruction device. The terminal apparatus comprises the ink amount measurement device and the ink amount determination device.

The printer of the above print system may comprise the recording medium parameter acquisition device, parameter input device and/or mode switching device as mentioned above.

To the contrary, the terminal apparatus may comprise such recording medium parameter acquisition device, parameter input device and/or mode switching device.

Another aspect of the present invention provides a print method in a print system comprising a print head that ejects ink, an upstream transfer device and a downstream transfer device. The upstream transfer device is provided in a feed path extending from a feed position to a counter area facing the print head. The upstream transfer device transfers a recording medium along the feed path. The downstream transfer device is provided in a discharge path extending from the counter area to a discharge position. The downstream transfer device transfers the recording medium along the discharge path. The downstream transfer device is made up of a drive roller and a driven roller. The recording medium is passed through between the rollers.

Particularly, this print method is used when an image is printed onto the recording medium by alternate instructions for the upstream transfer device to transfer of the recording medium or the downstream transfer device and for the print head to eject ink, based on print data showing an ink ejection pattern of a predetermined image. In the method, the amount of ink ejected by the print head is measured. Then, when the recording medium is transferred by the upstream transfer device and the front end of the recording medium is moved to a first position, it is determined whether the measurement value measured by the ink amount measurement device exceeds a preset value. The instructions based on the print data are discontinued if it is determined that the measurement value exceeds the preset value and the upstream transfer device is instructed to transfer the recording medium to the downstream transfer device from the first position. The upstream transfer device is further instructed to transfer the recording medium to a second position when the recording medium is transferred to the downstream transfer device and the front end of the recording medium is held between the drive roller and the driven roller. The second position is the position where the printing should be performed after the printing at the first position is completed. The second position is located at least downstream of the first position. The instructions based on the print data are continued after the front end of the recording medium is moved to the second position.

In this print method, the amount of ink may be measured based on the number of ink drops ejected from the print head.

It is preferable that the front end of the recording medium is held between the drive roller and the driven roller and left in that state for a while.

It is preferable that the upstream transfer device is instructed to transfer the recording medium to a second position from the downstream transfer device after the recording medium is transferred to the downstream transfer device and the front end of the recording medium is held between the drive roller and the driven roller. The second position is a position spaced apart from the first position by a predetermined distance on the side of the feed position. In this case, when the front end of the recording medium is moved to the second position, the upstream transfer device is instructed to transfer the recording medium to the first position from the second position. After the front end of the recording is moved to the first position, the instructions based on the print data are resumed.

It is further preferable that parameter data representing parameters of the recording medium is obtained from the outside. Depending on the parameters indicated in the parameter data, the value used for the determination of the measurement value may be modified.

It is further preferable that the parameters of the recording medium as the parameter data are obtained by a user input.

The operation mode of a print system employing the above print method may be switched between two modes: a suspension mode and a regular mode, according to the instructions from the outside. In the suspension mode, the instructions based on the print data are interrupted according to the determination result on whether the measurement value exceeds the preset value. In the regular mode, the instructions based on the print data are not interrupted regardless of the determination result.

The above print method can be implemented on a computer system. In this case, respective steps in the print method are executed as a computer program.

The program comprises a series of commands to be processed in a computer system. This program may be supplied to a print system, a printer, a terminal apparatus, a computer system or a user who works on the aforementioned, via a recording medium such as a FD, a CD-ROM, a memory card, etc. or a transmission line such as Internet, for example. The program is executed in a computer system embedded in a print system, a printer and a terminal apparatus or in a computer system capable of communicating with a print system, a printer and a terminal apparatus by wire or by radio.

BRIEF DESCRIPTION OF THE DRAWINGS

The invention will now be described, by way of example, with reference to the accompanying drawings, in which:

FIGS. 9A and 9B are illustrations showing how the printing paper is transferred on the platen;

DETAILED DESCRIPTION OF PREFERRED EMBODIMENT

First Embodiment

Figure 1:
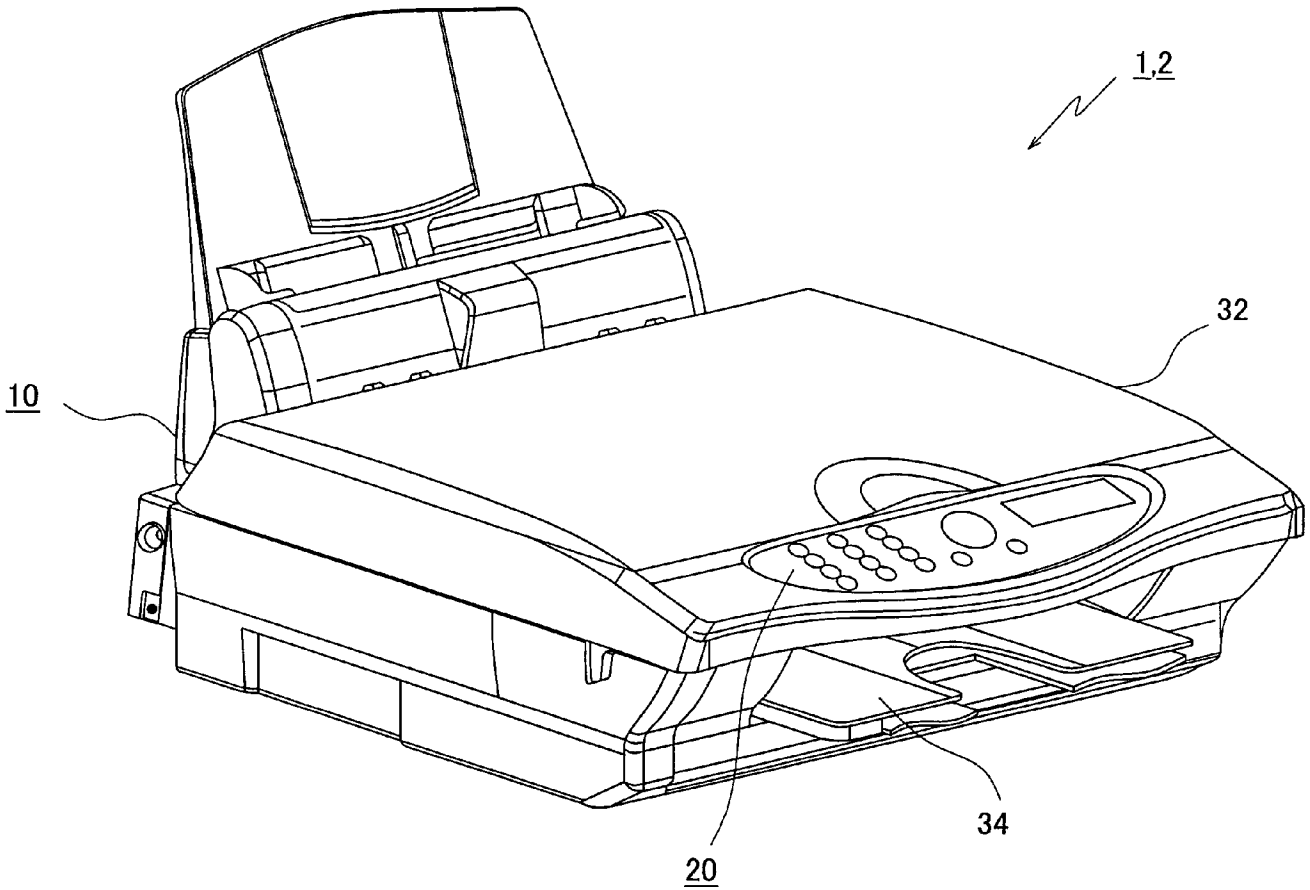
FIG. 1 is a perspective view showing an external appearance of a complex apparatus of an embodiment.

A complex apparatus 1 is an apparatus that serves as a printer, a copy machine, a scanner, a fax machine and a phone. As shown in FIG. 1, the complex apparatus 1 comprises a feed portion 10 provided at the back of the apparatus body, a user interface portion (hereafter, referred to as a user I/F) 20 provided at the front of the upper face of the apparatus body, a scanner portion 32 provided at the back of the upper face of the apparatus body, and a discharge tray 34 provided at the front of the apparatus body.

Figure 2:
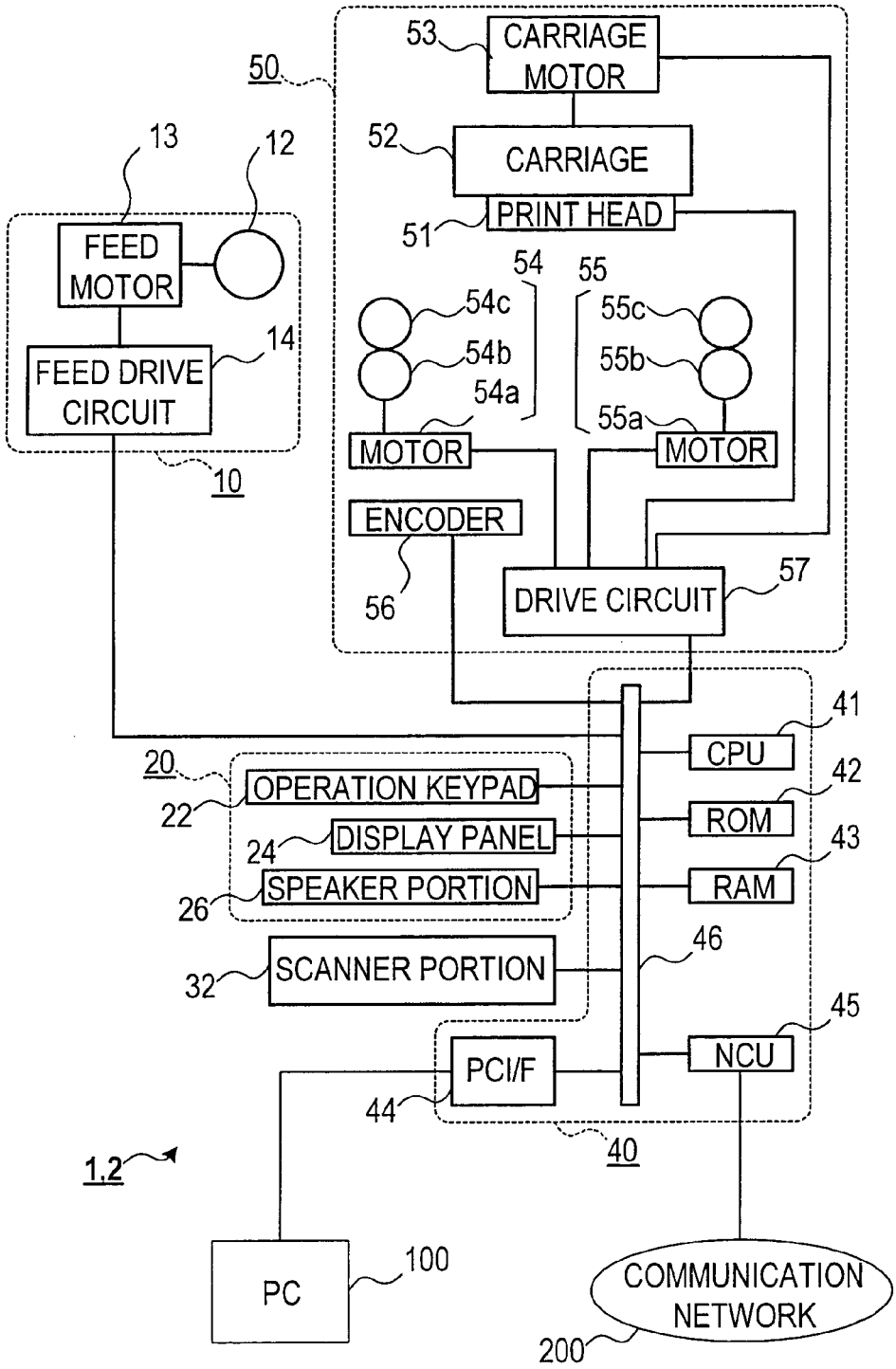
FIG. 2 is a block diagram showing a control system of the complex apparatus of the embodiment.

The complex apparatus 1 further comprises a control portion 40 that controls the overall operation of the complex apparatus 1 and a print portion 50 that performs printing onto a printing paper, as shown in FIG. 2, other than the aforementioned feed portion 10 and the scanner portion 32.

Figure 3:
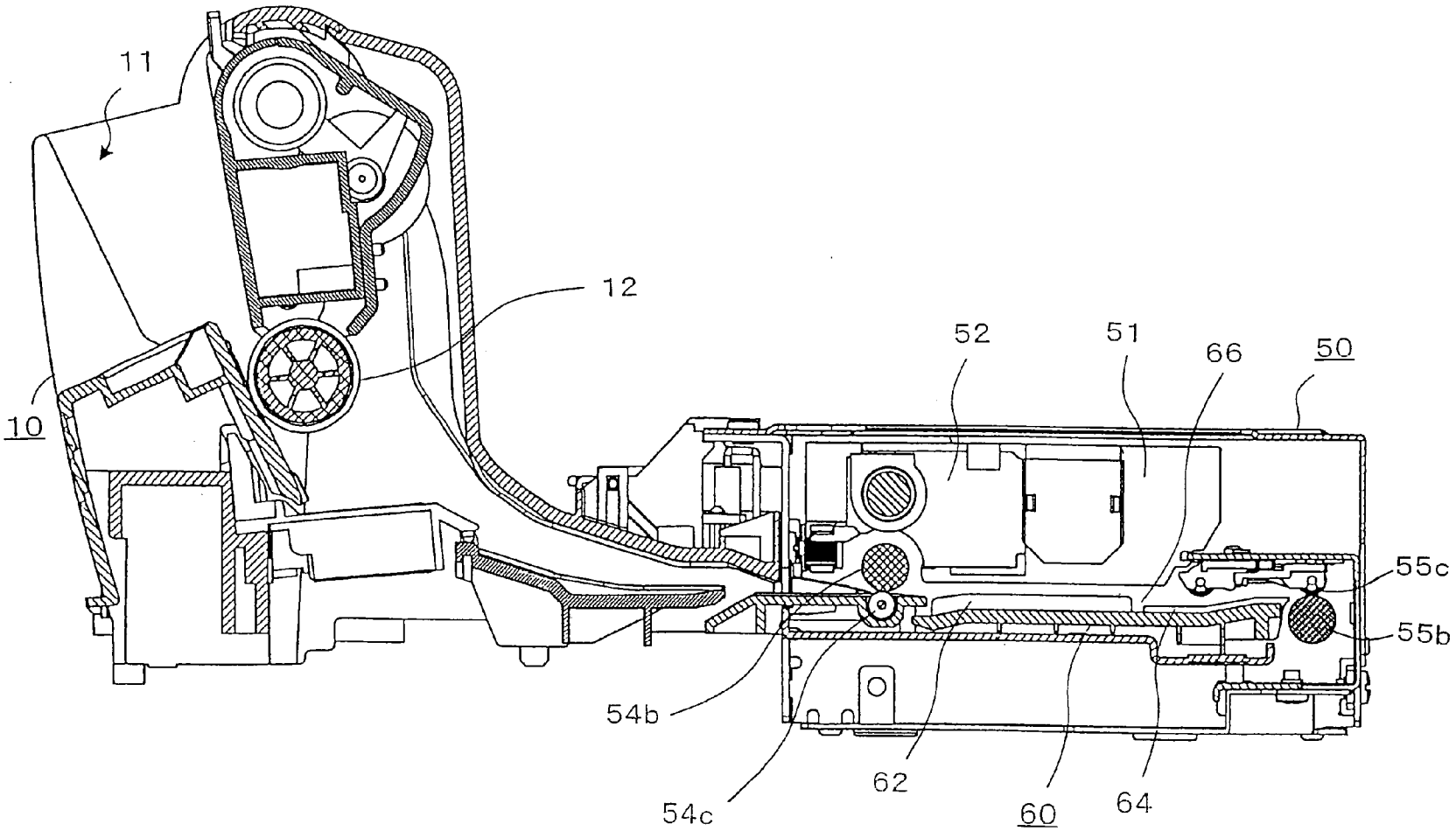
FIG. 3 is a cross sectional view showing a constitution of a feed portion and a print portion.

The feed portion 10 is composed of a feed roller 12 that transfers a printing paper set on a feed tray 11 toward the print portion 50, a feed motor 13 that rotates the feed roller 12 and a feed drive circuit 14 that drives the feed motor 13, as shown in FIGS. 2 and 3.

The user I/F 20 comprises an operation keypad 22 with various keys including numeric keys, selection keys used for a later-explained paper size designation process (FIG. 7), etc., a display panel 24 that displays various information, and a speaker portion 26 composed of a speaker and a drive circuit for activating a speaker.

The control portion 40 comprises a CPU 41, a ROM 42, a RAM 43, a PC interface (hereafter, referred to as a PCI/F) 44, NCU (network control unit) 45, etc. All the components of the control portion 40 are connected to each other via a bus 46. Among the above components, the CPU 41 controls the overall operation of the complex apparatus 1 by following the process steps stored in advance in the ROM 42. The CPU 41 stores the result of the process in the RAM 43 and simultaneously transmits commands to the respective components of the complex apparatus 1 via the bus 46. The PCI/F 44 is an interface that allows the complex apparatus 1 to communicate with a known personal computer (hereafter, referred to as a PC) 100 via a communication cable. The NCU 45 is an interface that connects the complex apparatus 1 with a communication network 200.

The print portion 50 comprises a carriage 52 provided with a print head 51, a carriage motor 53 that moves the carriage 52 in a primary scanning direction (direction orthogonal to a transfer direction of a printing paper), a transfer mechanism 54 that transfers the printing paper fed from the feed portion 10 to a counter area facing to the print head 51, a discharge mechanism 55 that delivers the printing paper transferred from the transfer mechanism 54 to the discharge tray 34, an encoder 56 that detects the amount of the printing paper transferred by each mechanism 54, 55, a drive circuit 57 that drives the print head 51, carriage motor 53, transfer mechanism 54 and discharge mechanism 55. Among the above components, each of the transfer mechanism 54 and the discharge mechanism 55 is composed of a motor 54*a*, 55*a* to be driven by the drive circuit 57, a drive roller 54*b*, 55*b* to be rotated by the motor 54*a*, 55*a*, and a driven roller 54*c*, 55*c*. The driven roller 55*c* of the discharge mechanism 56 is a star-shaped roller having a star-shaped cross section. One and the same motor may be used for the motor 54*a*, 55*a* that drives each of the transfer mechanism 54 and the discharge mechanism 65.

As shown, in FIG. 3, in a path from the transfer mechanism 54 to the discharge mechanism 55 in the print portion 50, a platen 60 is provided that guides a printing paper to be transferred along the path.

Figure 4:
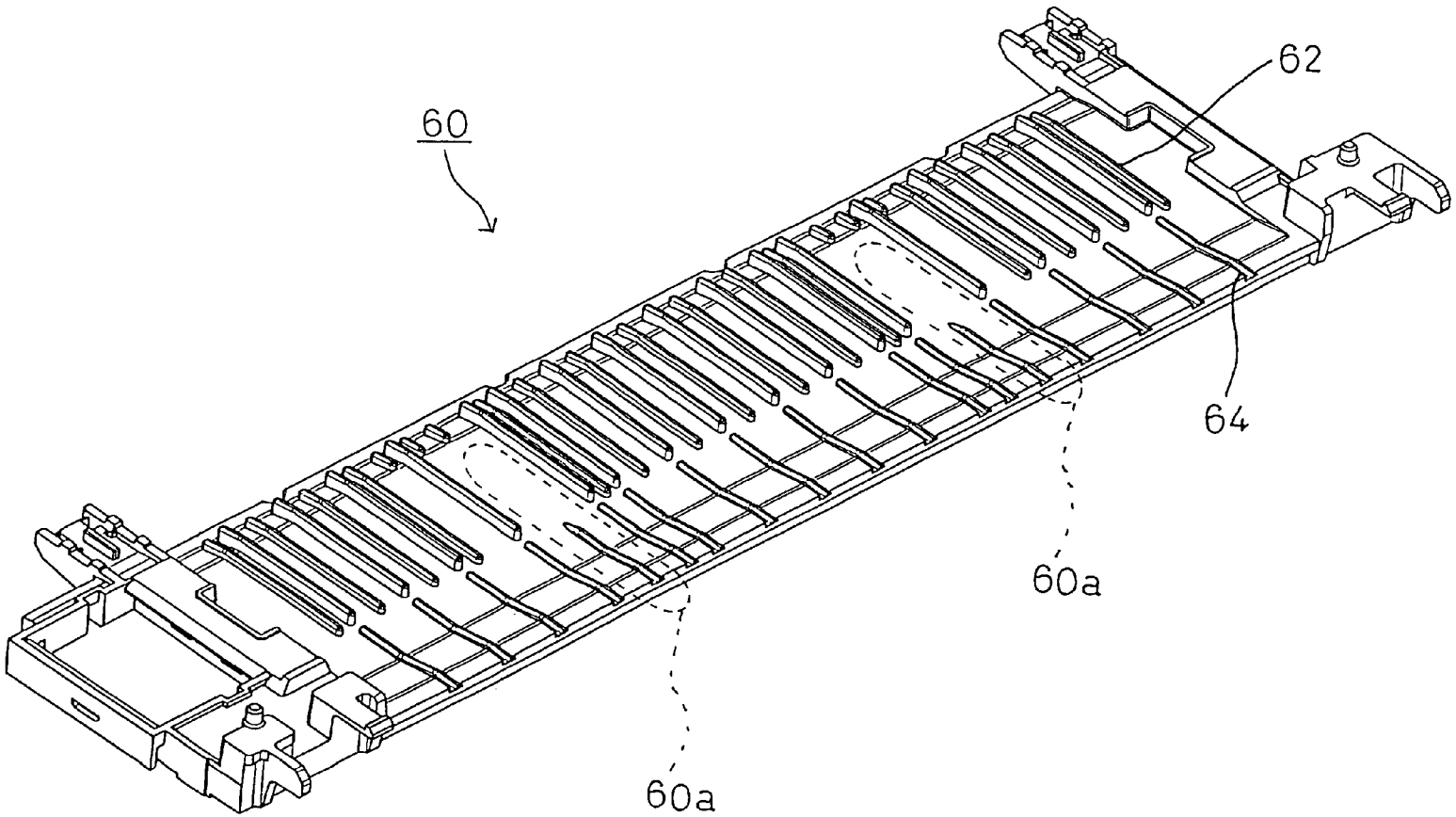
FIG. 4 is a perspective view showing an external appearance of a platen.

As shown in FIGS. 3 and 4, the platen 60 comprises a plurality of feed ribs (projected portions) 62 and a plurality of discharge ribs 64. The feed ribs 62 extend from an end of the platen 60 on the side of the transfer mechanism 54. The discharge ribs 64 extend from an end of the platen 60 on the side of the discharge mechanism 55. Both the feed ribs 62 and the discharge ribs 64 are formed in parallel to the transfer direction of a printing paper. The printing paper is passed over on the respective feeds ribs 62, clearance 66 created between each of the ribs 62, 64, and discharge ribs 64. The printing is performed when the printing paper is on the feed ribs 62.

The feed ribs 62 are configured so that the horizontal position of the feed ribs 62 with respect to the body part of the platen 60 (vertical direction in FIG. 3 drawing) is higher than that of the discharge ribs 64. There are areas where both of a feed rib 62 and a discharge rib 64 are successively provided in the transfer direction of the printing paper and where only a feed rib 62 or a discharge rib 62 is provided in the transfer direction of the printing paper. In the area 60*a* where only a discharge rib 64 is provided, one end of the discharge rib 64 on the side of the transfer mechanism 54 is chamfered.

(Print Process by CPU 41)

Steps in the print process performed by the CPU 41 of the control portion 40 are described below by way of FIG. 5. The print process is started when the print data is inputted via the scanner portion 32, PCI/F 44 or NCU 45, The print data represents an ink ejection pattern of an image generated by the print head 51. Particularly, the print data is an array of sub-data. Each sub-data includes the ink ejection pattern from the print head 51 and the transfer amount of the printing paper in one primary scan. The sub-data are provided as much as the number of secondary scan times required for printing the whole image in one piece of printing paper.

First of all, a paper is fed from the feed portion 10 to the print portion 50 (S110). In this step, the feed roller 12 of the feed portion 10 is rotated to feed the printing paper to the print portion 50.

Next, a drop counter is cleared (S120). The drop counter is provided for counting the number of drops ejected from the print head 61 for the printing. The number of ink drops is incremented every time an ink drop is ejected from the print head 51 from step S120 onward. The number of ink drops used in so-called flushing is not counted, since those ink drops are not ejected onto the printing paper but ejected in a space for flushing. Flushing is performed for the purpose of preventing ink clogging.

Next, a piece of sub-data corresponding to one primary scan is taken out of the print data (S130). If this step S130 is to be performed more than once after the present print process is started, the sub-data to be taken out for the second time and afterward is the sub-data corresponding to the next primary scan. The sub-data corresponding to the next primary scan is the sub-data corresponding to one primary scan to be followed after the last primary scan. The sub-data corresponding to the last primary scan is the sub-data taken out most recently in step S130.

Figure 6A:
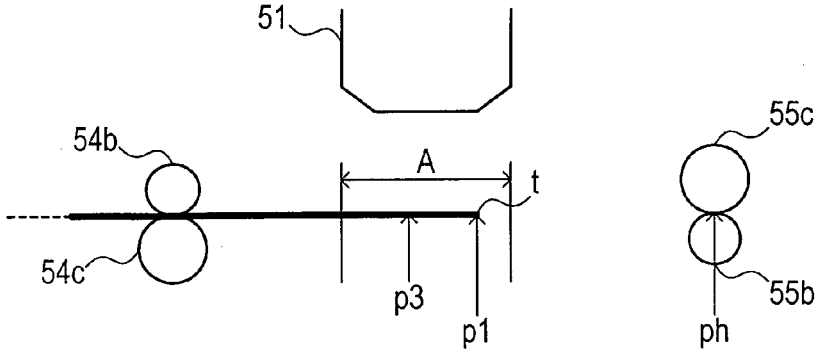
FIGS. 6A, 6B, 6C and 6D are illustrations showing how a printing paper is transferred.

Next, it is determined whether the front end t of the printing paper has reached to a determination position (first position) p1 in the counter area facing the print head 51 after the next secondary scan (S140). In this step, whether the front end t of the printing paper has reached to the determination point p1 is checked according to the output of the encoder 56 (see FIG. 6A). Accordingly, in step S140, positive determination can be made only once per one piece of printing paper.

Figure 7:
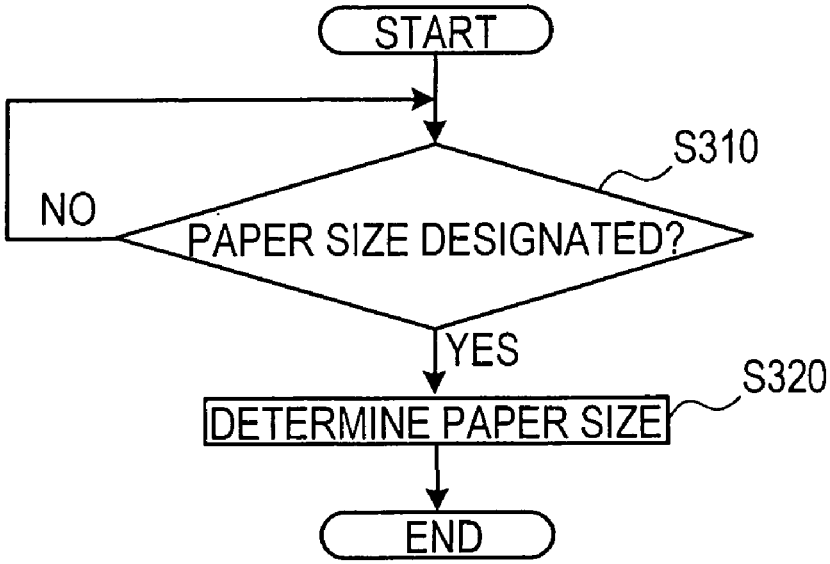
FIG. 7 is a flowchart showing steps of a paper size designation process.

If it is determined that the front end t of the printing paper has reached to the determination point p1 after the next secondary scan in step S140 (S140: YES), it is checked whether the print state so far is regarded as "heavy-duty" based on the count value in the drop counter (S150). In this step, the ink amount determined from the count value in the drop counter is regarded as the ink amount ejected from the print head 51 onto the printing paper during which the front end t of the printing paper, after entered into the counter area A, is moved to the determination position p1. The state in which it is assumed that the ink amount is enough to cause deformation of the printing paper is determined "heavy-duty". Here, the ink amount "enough to cause deformation" is the ink amount obtained by experiments in advance. The amount becomes large as the size (width) of the printing paper becomes large. In the present embodiment, when it is determined whether the print state is "heavy-duty", the ink amount is used that is "enough to cause deformation" corresponding to the paper size indicated in the size data stored in the RAM 43. The size data represents the paper size designated in a later-explained paper size designation process (FIG. 7). The drop counter counts the number of ink drops ejected during a single primary scan. Accordingly, one determination value for determining whether the print state is "heavy-duty" is provided per size of paper having a different primary scan length.

The ink amount determined "heavy-duty" is the ink amount "enough to cause deformation of the printing paper". Therefore, the ink amount used for the determination is not changed by resolution at recording. Here, the amount of ink ejected from all the nozzles of the print head 51 in the normal printing mode (150 dpi) is used as the base. Accordingly, if the amount of an ink drop is constant, the determination of the print state can be made by counting the number of the ejected ink drops. If the amount of an ink drop is reduced as in the case of printing in high resolution, the number of times when the determination is performed is increased.

Figure 6B:
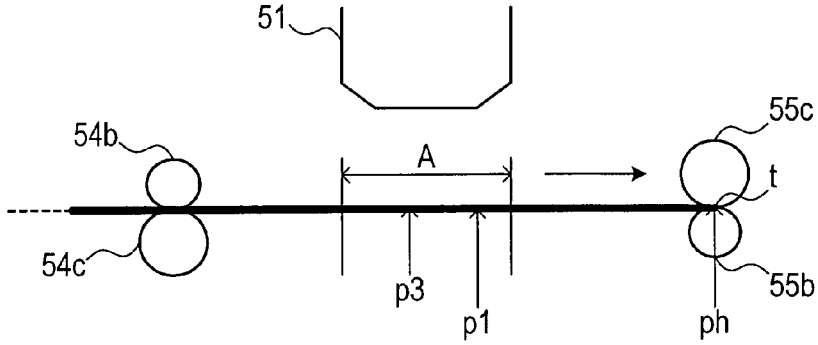

In step S150, if the print state is determined "heavy-duty" (S150: YES), the printing paper is transferred to the discharge mechanism 55 (S160). In this step, the drive rollers 54*b*, 55*b* are rotated while the transfer amount of the printing paper known from the output of the encoder 56 is being checked. Consequently, the front end t of the printing paper is moved to the hold position ph to be held between the respective rollers 55*b*, 55*c* of the discharge mechanism 55 (see FIG. 6B). The hold position ph to which the front end t of the printing paper is moved can be a position beyond the rollers 55*b*, 55*c* of the discharge mechanism 55, so that the front end t may protrude on the side of the discharge tray 34. When the distance between the front end t of the printing paper and the discharge mechanism 55 becomes smaller than a predetermined distance, the rotation speed of the drive rollers 54*b*, 55*b* is decreased so that the transfer speed of the printing paper is also decreased. In this manner, deformation of the front portion of the printing paper resulting from a collision of the front end t against the respective rollers 55*b*, 55*c* of the discharge mechanism 55, is avoided.

Next, the front end t of the printing paper is held between the respective rollers 55*b*, 55*c* of the discharge mechanism 55 for a predetermined time (four seconds in the present embodiment) (S170). The predetermined time is experimentally determined in consideration of the time assumed necessary to dry the ink ejected onto the printing paper and the time required for recovery of a portion of the paper from the deformation due to ink moisture.

Figure 6C:
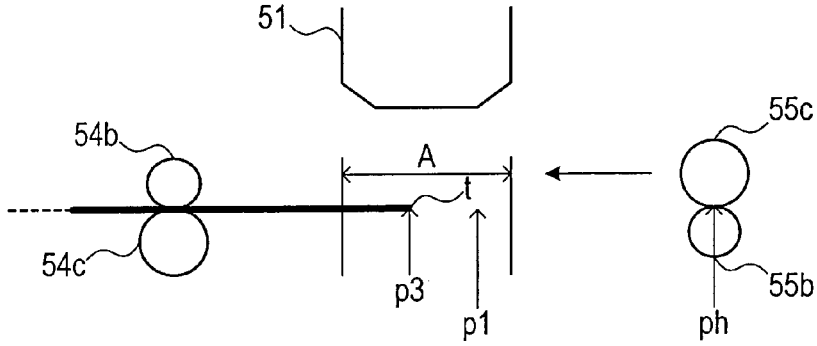

Next, the front end t of the printing paper is moved to a recovery position (third position) p3 which is spaced apart from the determination position p1 in the counter area A by a predetermined distance (5 mm in the present embodiment) on the side of the transfer mechanism 54 (S180). In this step, the drive rollers 54*b*, 55*b* are rotated while the transfer amount of the printing paper, that is, the output of the encoder 56, is being verified. Consequently, the front end t of the printing paper is moved to the recovery position p3 (see FIG. 6C). The transfer speed of the printing paper to the recovery position p3 is made slower than that to the hold position ph. This is because the transfer of the printing paper to the recovery position p3 corresponds to operation of drawing the printing paper backward. This operation is assumed to apply a heavier load on the paper than that applied by the operation of drawing the paper forward.

Next, the printing paper is transferred to a position in the counter area A where the front end t is allowed to reach the determination position p1 after the next secondary scan (S190). In this step, the drive rollers 54*b*, 55*b* are rotated while the transfer amount of the printing paper known from the output of the encoder 56 is being checked. Consequently, the printing paper is transferred to the position where the front end t is allowed to reach the determination position p1 after the next secondary scan (see FIG. 6A).

Figure 6D:
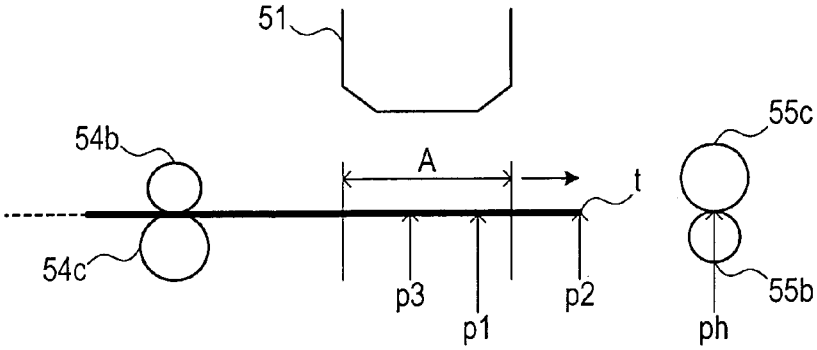

After step S190 is completed in the above manner, the printing paper is transferred to its normal transfer direction as much as the transfer amount indicated in the data taken out in step S130 (i.e. to a second position p2; see FIG. 6D) (S200), in the same manner as when it is determined that the front end t of the printing paper has not reached the determination position p1 in step S140 (S140: NO) or when it is determined that the print state is not "heavy-duty" in step S150 (S150: NO). The second position p2 is the position where the printing should be performed next to the printing at the determination position p1. In this step, the drive rollers 54*b*, 55*b* are rotated to transfer the printing paper while the transfer amount of the printing paper, that is, the output of the encoder 56 is being verified.

Next, ink is ejected from the print head 51 according to the ejection pattern indicated in the data taken out in step S130 while the print head 51 (carriage 52) is moved to the primary scanning direction by the carriage motor 53 (S210). As a result, the image corresponding to a single primary scan is printed on the printing paper. The count value is incremented by the drop counter.

Next, whether there is the data corresponding to the next primary scan is checked (S220). If the data exists (S220: YES), the process returns to step S130.

In this manner, steps S130 to S220 are repeated till there is no data corresponding to the next primary scan. If no data exists in step S220 (S220: NO), the printing paper is discharged from the print portion 50 to the discharge tray 0.34. The present print process is ended. In step S230, the discharge mechanism 55 is operated till the printing paper is transferred to the discharge tray 34.

(Paper Size Designation Process by CPU 41)

Steps in the paper size, designation process performed by the CPU 41 of the control portion 40 are described below by way of FIG. 7. The paper size designation process is started when a paper selection key on the operation keypad 22 of the user I/F 20 is depressed.

The CPU 41 stands by till the paper size is designated by the user (S310). After the paper selection key is depressed, the user can operate the operation keypad 22 to designate the size of the paper which is set or to be set. The paper size to be designated are "letter", "A4", "B5", "A5", "B6", "post card" and "L-form". In this step S310 the CPU 41 stands by till the operation of selecting one of the above paper sizes is performed.

When the paper size is selected in step S310 (S310: YES), the chosen paper size is determined to be the paper size of the printing paper to be used for printing an image (S320). In this step, the size data representing the chosen paper size is recorded in the RAM 43 in order to determine the paper size of the printing paper for the image printing. This size data is the data to be used in step S150 of FIG. 6. According to the determined paper size, the determination value, used for determining whether the print state is "heavy-duty", is changed.

[Effects in First Embodiment]

According to the complex apparatus 1 in the present embodiments if the amount of ink ejected on the front portion of the printing paper exceeds the ink amount "enough to cause deformation" of the printing paper, the image printing based on the print data is interrupted. The amount of ink ejected on the front portion is the amount of ink ejected from the print head 51 till the front end of the printing paper reaches to the determination position p1 after the entry into the counter area A. During the interruption, steps S160 to S190 in FIG. 5 are performed. The front end t of the printing paper is moved from the determination position p1 to the hold position ph in step S160, and then returned to the determination position p1 in step S190. The printing based on the print data is resumed at this point. When the front end t of the printing paper is moved to the hold position ph, the front end t is held between the drive roller 55*b* and the driven roller 55*c* making up the discharge mechanism 55. Consequently, the front portion of the printing paper is kept straightened by being held respectively between the rollers 54*b*, 54*c* of the transfer mechanism 54 and between the rollers 55*b*, 55*c* of the discharge mechanism 55. Thus, the deformation of the printing paper due to drying of ink can be avoided.

Figure 5:
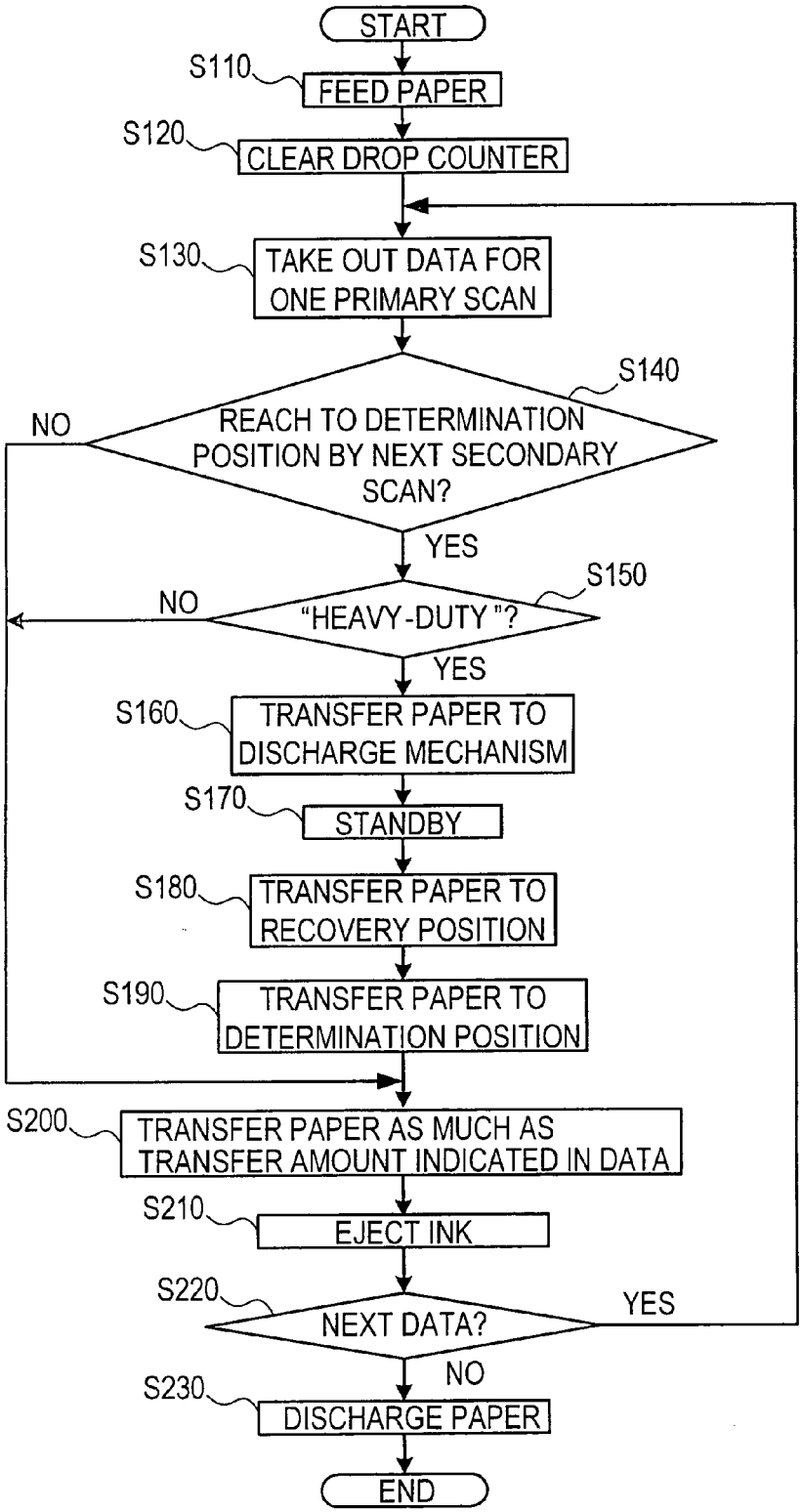
FIG. 5 is a flowchart showing steps of a print process.

In step S170 of FIG. 5, the front portion of the printing paper is left in a state of being held between the rollers 55*b*, 55*c* of the discharge mechanism 55 for a predetermined time (four seconds). Therefore, deformation of the printing paper due to the drying of ink on the printing paper can be reliably prevented within the predetermined time, The front end t of the printing paper is moved to the recovery position p3 beyond the determination position p1 on the side of the transfer mechanism 54 after left for a while in step S170 of FIG. 5. Then, the front end t of the printing paper is transferred to the determination position p1 in step S190 so that the image printing based on the print data is resumed. The front end t of the printing paper is moved to the recovery position pa which is closer to the transfer mechanism 54 than the determination position p1. The transfer direction of the printing paper is reversed at the recovery position p3, and not at the determination position p1. When there is a reverse in the transfer direction of the printing paper, an error may occur in the transfer amount of the printing paper due to the structure of the transfer mechanism 54. Accordingly, if the printing paper is returned to the determination position p1 directly from the hold position ph, the position where the image printing should be continued is misaligned, resulting in that the print quality may be deteriorated. Thus, avoidance of the reverse in the transfer direction at the determination position p1 achieves a beneficial effect on preventing misalignment of the position where the image printing should be continued and helps maintain high print quality.

The ink amount when determined whether the print state is "heavy-duty" in step S150 of FIG. 5 can be changed according to the paper size designated in the paper size designation process in FIG. 7.

The CPU 41 of the control portion 40 acquires the size data representing the paper size of the printing paper in the paper size designation process in FIG. 7. The CPU 41 can determine whether the print state is "heavy-duty" based on the paper size indicated in the size data.

Figure 8A:
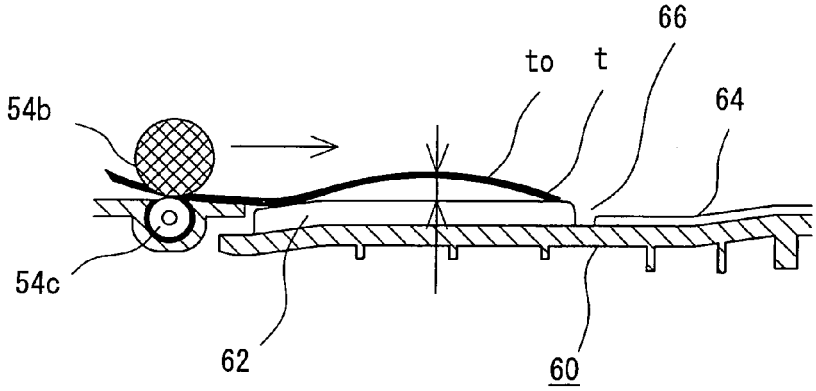
FIGS. 8A, 8B and 8C are illustrations showing how the printing paper is transferred on the platen.

Even if it is determined that the print state is not "heavy-duty" in step S150 of FIG. 5, it is possible that subtle deformation may occur in the front portion of the printing paper. This happens when the ink amount ejected onto the front portion of the printing paper is a little less than the ink amount "enough to cause deformation". In this case, as shown in FIG. 8A, the front portion t0 of the printing paper partially loses contact with the platen 60. Since a part of the printing paper gets close to the print head 51, the print quality is deteriorated. To avoid this situation, the ink amount "enough to cause deformation" of the printing paper used when determined whether the print state is "heavy-duty" in step S150 may be set lower. However, the lower the ink amount is set, the more frequently the printing based on the print data is interrupted (steps S160 to S190 are repeated more often), producing undesirable results that the time required for printing by the print portion 50 becomes longer. In the present embodiment, the above problem is solved by way of the shape of the platen 60.

Figure 8B:
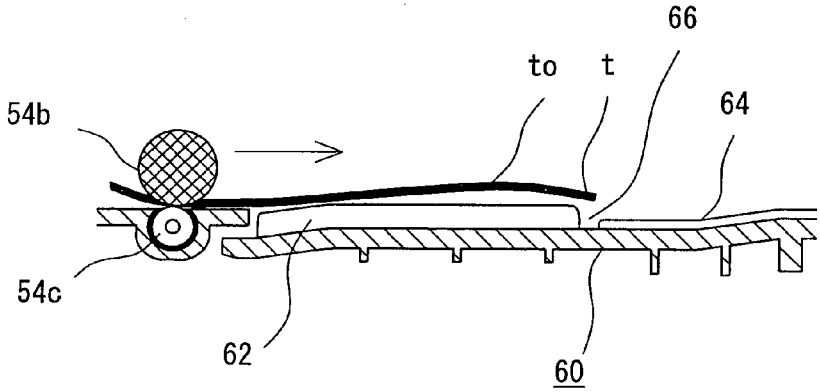
Figure 8C:
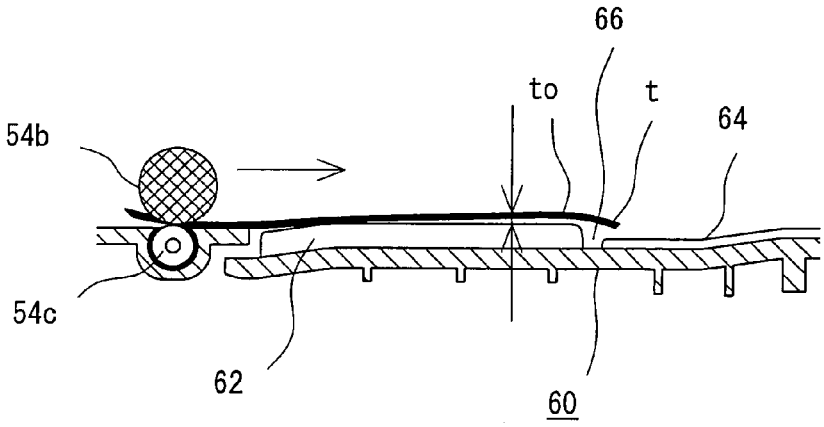

As mentioned before, the horizontal position of the feed ribs 62 of the platen 60 with respect to the body part of the platen 60 is designed to be higher than that of the discharge ribs 64. Also, there is clearance 66 between the feed ribs 62 and the discharge ribs 64 where no rib is provided (see FIG. 3). As a result, even if subtle deformation occurs in the printing paper transferred from the transfer mechanism 54, resulting in that the front portion to loses contact with the platen 60 (see FIG. 8A), the front end t is lowered once when passed from the feed ribs 62 to the discharge ribs 64 over the clearance 66 without ribs (see FIG. 8B). This brings the front portion t0 close to the feed ribs 62. Furthermore, when the front end t of the printing paper abuts the upper part of the discharge ribs 64 positioned lower than the feed ribs 62 (see FIG. 8C), the front portion to of the printing paper is brought close to the feed ribs 62. In this manner, separation of the front portion to of the printing paper from the platen 60 can be inhibited.

Figure 9A:
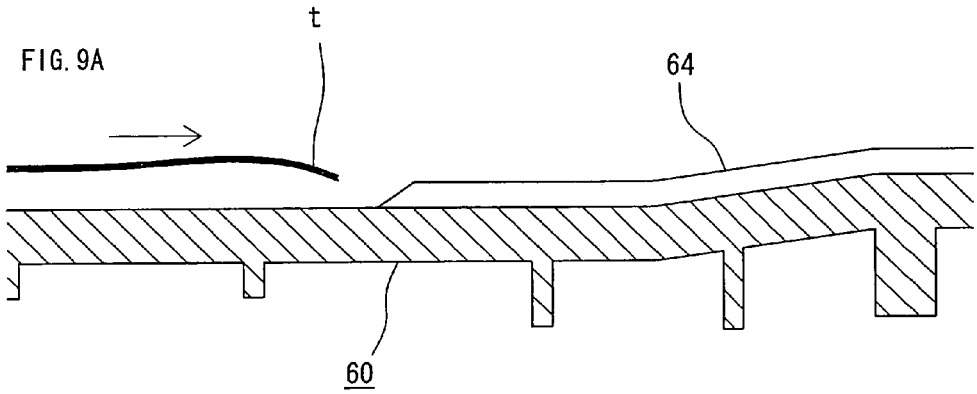
Figure 9A:
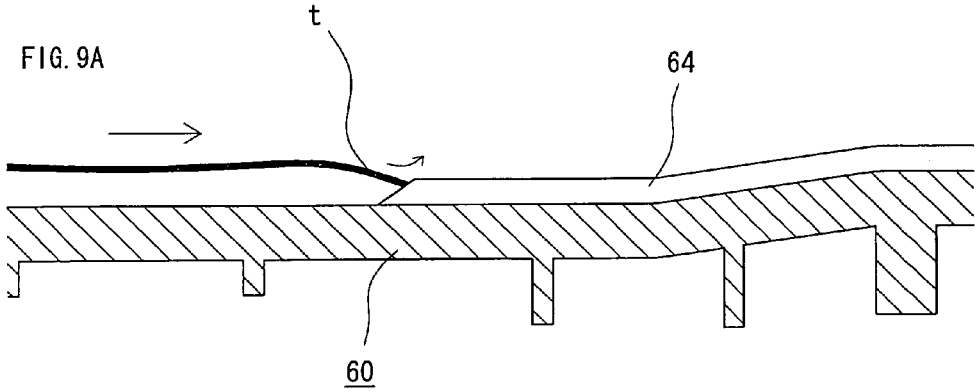

In the area 60*a* in this platen 60 where only a discharge rib 64 is provided, one end of the discharge rib 64 is chamfered on the side of the transfer mechanism 54. As a result, even if the aforementioned subtle deformation occurs at a section of the front portion to passing over the area 60*a* or the front end t of the printing paper bows due to its own weight (see FIG. 9A), the front end t can be properly guided toward the discharge mechanism 55.

Second Embodiment

A complex apparatus 2 is provided with the components identical to those in the complex apparatus 1 in the first embodiment. Therefore, only the difference is explained hereafter. The complex apparatus 2 constitutes a print system together with the PC 100.

(Print Data Transmission Process by PC 100)

Steps in the print data transmission process performed by a CPU mounted on the PC 100 are described below by way of FIG. 10. The steps in the print data transmission process are processed by a printer driver installed in the PC 100. The print data transmission process is started when prescribed operation for printing an image is carried out in application software running on the PC 100. When such operation is made, not only the image data but also the data representing the paper type to be used for the printing, paper thickness, and paper size are delivered to the printer driver. The aforementioned "paper type" includes, for example., standard paper, OHP (overhead projector) sheet and exclusive glossy paper. The "paper thickness" indicates whether the paper is card paper.

First of all, a drop number counter and a card paper flag are reset, respectively (S410). In this step, the drop number counter for counting the number of drops to be ejected by the complex apparatus 2 (print head 61 of the print portion 50) is reset. Also, the card paper flag is set to "0".

Then, the print data based on the image data is generated (S420).

Next, the type of printing paper to be used is determined (S430). In this step., it is determined whether the printing paper to be used is the standard paper or other paper based on the data delivered together with the image data.

If it is determined in step S430 that the printing paper is the OHP sheet or exclusive glossy paper (S430: NO), the sub-data corresponding to each primary scan of the print data is transmitted to the complex apparatus 2 in a sequential order (S440). This is because such paper do not absorb water and deformation is not likely to occur. In this case, it is not necessary to count the number of ink drops ejected on the printing paper.

If the print data for all the pages are not yet transmitted to the complex apparatus 2 (S450: NO), the process returns to step S440. If the print data for all the pages have been transmitted (S450: YES), the present print data transmission process is ended.

If it is determined in step S430 that the printing paper to be used is the standard paper (S430: YES), the thickness of the printing paper is checked (S460). In this step, it is determined whether the printing paper is card paper based on the data delivered together with the image data.

If it is determined in step S460 that the printing paper is card paper such as a post card (S460: YES), the card paper flag is set to "1" (S470).

After step S470 is completed, or, if it is determined, in step 8460 that the printing paper is not card paper (S460: NO), drop density of ink which is assumed to be ejected onto the printing paper when the image shown in the image data is printed by the complex apparatus 2 is calculated (S480). In this step, when the image shown in the image data is printed by the print portion 50 (print head 51) of the complex apparatus 2, the number of ink drops expected to be ejected onto the front portion (the side of the front end t in FIG. 6) of the printing paper is counted, during from the start of the printing until the printing paper reaches to the determination position p1 shown in FIG. 6. Then, based on the count value obtained and the paper size shown in the data delivered together with the image data, the average drop density, in the area on the printing paper, of ink to be ejected is calculated.

Next, it is determined whether the ink drop density calculated in step S480 exceeds a preset value which is "enough to cause deformation" in the front portion of the printing paper (S490). The preset value is determined by dividing the number of ink drops ejected onto the front portion of the printing paper by a ratio of the width of the printing paper to the letter width. In this case, a half amount of ink ejected from all the nozzles of the print head 51 to the letter width in the normal printing mode is used as the base.

If it is determined in step S490 that the density exceeds the preset value (S490: YES) and if the card paper flag is set to "1" (S500: YES), first command data is added to the sub-data showing the ink ejection pattern and the transfer amount of the printing paper in the first primary scan of the print data (S510). On the other hand, if it is determined in step S490 that the density exceeds the preset value (S490: YES) and if the card paper flag is set to "0" (S500: NO), second command data is added to the aforementioned sub-data (S520). The command data added in step S510, S520 respectively includes a command for making the complex apparatus 2 execute steps corresponding to S160 to S190 of FIG. 5. Only difference between the first and second command data lies in the standby time in step S170. These command data are added to the transfer instructions which are given when the front end t of the printing paper reaches to the determination position p1 shown in FIG. 6 at the next secondary scan. In the print process of the CPU 41, it is determined that the print density in the front portion of the printing paper has exceeded the preset value if one of the above command data is detected, and further performs operation of straightening the front portion of the paper. In the present embodiment, the standby time is set to two seconds in the first command data, and four seconds in the second command data.

After step S510, S520 is completed, or, if it is determined in step S490 that the density does not exceed the preset value (S490: NO), the sub-data corresponding to the respective secondary scans of the print data are transmitted to the complex apparatus 2 by turns (S530).

If it is determined that the print data for all the pages, generated in step S420, are not transmitted to the complex apparatus 2 (S540: NO), the drop number counter is reset (S550) and the process returns to step S480. If the print data for all the pages have been transmitted (S540: YES), the present print data transmission process is ended.

(Print Process by CPU 41)

Figure 11:
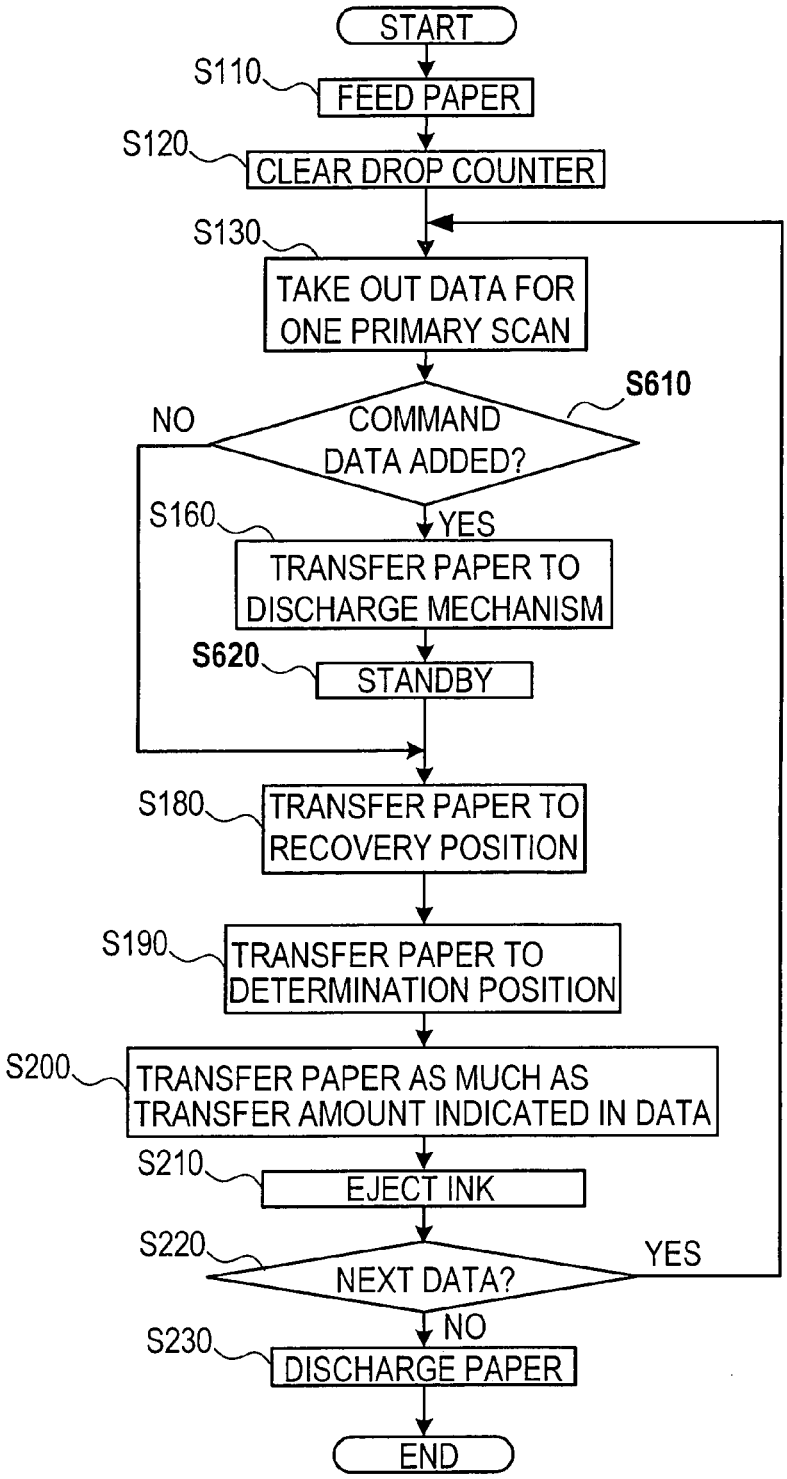
FIG. 11 is a flowchart showing steps of a print process according to another embodiment.

Steps in the print process performed by the CPU 41 of the control portion 40 are described below by way of FIG. 11. This print process is only partially different from the print process in the first embodiment (FIG. 5). Accordingly, only the difference will be explained in details hereafter. Steps having the numbers identical to those in the first embodiment are identical steps to those in the first embodiment.

First, a paper is fed from the print portion 10 to the print portion 50 (silo).

Then, the drop counter is cleared (S120).

Next, a piece of sub-data for one primary scan is taken out from the print data (S130).

It is determined whether the sub-data obtained in step S130 has additional command data (S610). The command data checked in this step is the data added by the PC 100 in step S510 or S520 of FIG. 10.

If it is determined in step S610 that the command data is added to the obtained sub-data (S610: YES), the print density in the front portion of the printing paper is considered to have exceeded the preset value. Therefore, the front end t of the printing paper is transferred to the discharge mechanism 55 (S180).

The front portion of the printing paper is held between the respective rollers 55*b*, 55*c* of the discharge mechanism 55 and left as it is for the predetermined time (S620). In this step, if the command data added to the sub-data obtained in step S130 is the "first command data", the printing paper is held between the rollers 55*b*, 55*c* for two seconds. If the command data is the "second command data", the printing paper is held therebetween for four seconds.

Then, the front end t of the printing paper is moved to the recovery position p3 which is spaced apart from the determination position p1 in the counter area A by a predetermined distance on the side of the transfer mechanism 54 (S180).

The front end t of the printing paper is then transferred to the determination position p1 in the counter area A (S190).

After step S190 is completed, or, when it is determined in step S610 that no command data is added to the sub-data obtained in step S130 (8610: NO), the printing paper is transferred to the normal transfer direction by the transfer amount indicated in the sub-data obtained in step S130 (S200).

Next, ink is ejected according to the ejection pattern shown in the sub-data obtained in step S130 while the print head 51 is moved to the primary scanning direction by the carriage motor 53 (S210).

Next, it is determined whether the sub-data corresponding to the next primary scan exists (S220). If the sub-data exists (S220: YES), the process returns to step S130.

After steps S130 to S220 are repeated as necessary and if it is determined that no sub-data corresponding to the next primary scan exists (S220: NO), the printing paper is discharged from the print portion 50 to the discharge tray 34 (S230). The present print process is ended.

[Effects in the Second Embodiment]

According to the above complex apparatus 2, when the drop density of ink ejected onto the front portion of the printing paper (i.e. ink density on the front portion of the printing paper) becomes the density "enough to cause deformation" of the front portion, the image printing based on the print data is interrupted in the same manner as in the first embodiment, and steps S160 to S190 are performed. Consequently, deformation of the printing paper due to the drying of ink ejected onto the printing paper can be prevented. Also, misalignment of the position where the image printing should be resumed can be avoided.

[Modifications]

In the above, embodiments of the present invention have been described. However, the present invention should not be limited to the particular embodiments described above, and other modifications and variations may be possible.

For instance, in the above embodiments, the configuration of the print system of the present embodiment is applied to the complex apparatus 1 or a system comprised of the complex apparatus 2 and the PC 100. However, the print system of the present invention may be comprised of the apparatus other than the complex apparatus provided that the apparatus comprises a unit corresponding to the print portion 50.

In the above embodiments, steps shown in FIG. 5, 11 are performed by the computer system of the CPU 41 in the complex apparatus. However, part or all of these steps may be executed by another computer system connected with the complex apparatus by a wire/radio signal transmission path.

Figure 10:
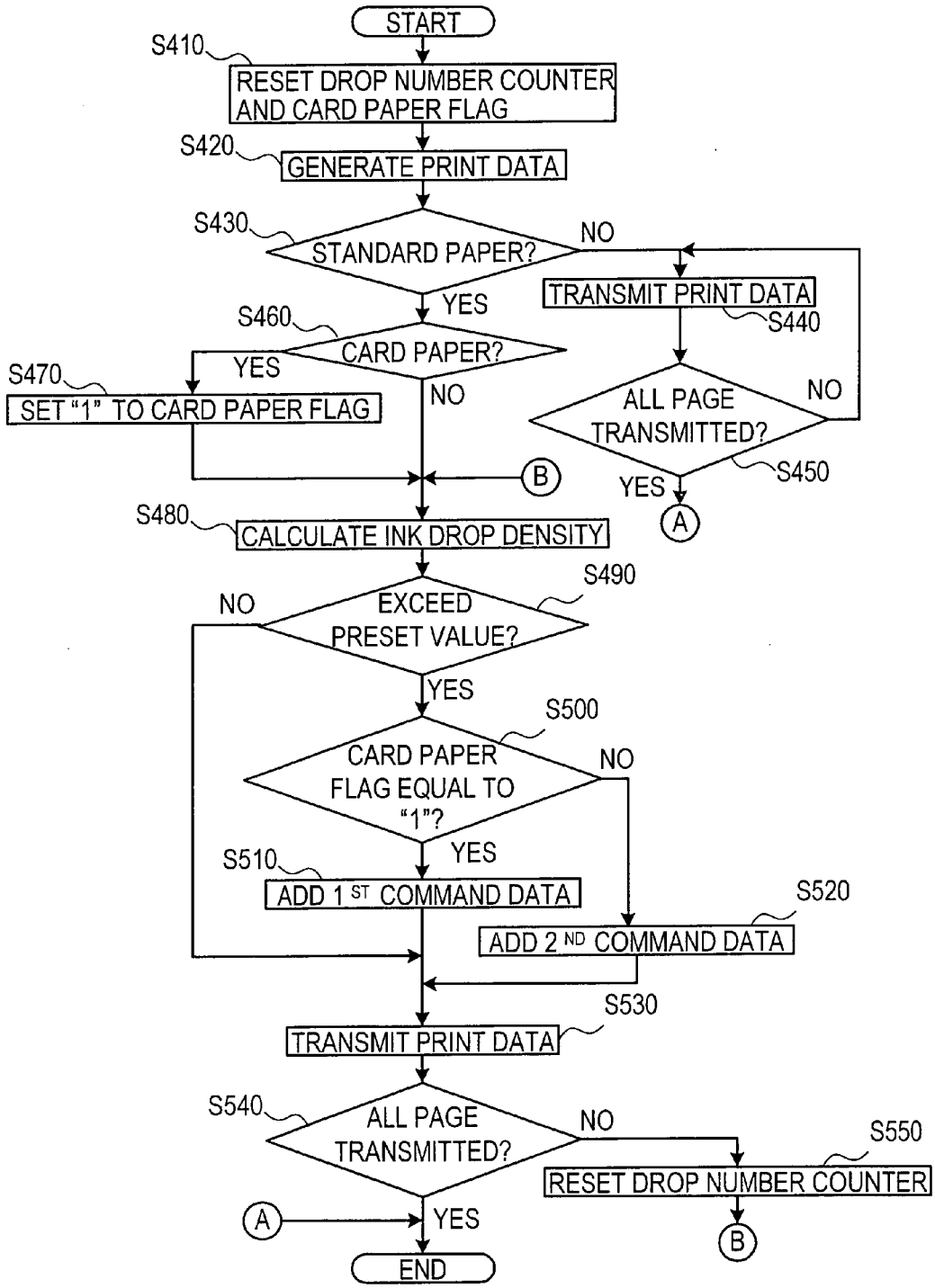
FIG. 10 is a flowchart showing steps of a print data transmission process.

In the above embodiments, steps in FIG. 10 are performed by the CPU mounted on the PC 100. However, part or all of these steps may be executed by another computer system connected with the complex apparatus by a wire/radio signal transmission path.

In the above embodiments, steps in FIG. 5, 11 are executed according to the manner stored in the ROM 42 of the complex apparatus. However, if the complex apparatus is configured to exchange data with a medium such as a FD or a memory card, the above steps may be performed according to the manner recorded in such a medium.

In the above embodiments, the CPU 41 of the control portion 40 directly controls all the components (except for motors) of the complex apparatus. However, part or all of the components of the complex apparatus may be controlled indirectly via an integrated circuit (such as ASIC (application specific integrated circuit)).

In the above first embodiment, the number of ink drops ejected from the print head 51 is counted by the drop counter in real time. However, ink ejection times known from the ejection pattern indicated in the print data may be counted in advance by a dot counter. In this case, the dot counter is reset in step S120 of FIG. 5. In step S130, a piece of sub-data is taken out from the print data and the ink ejection times specified by the obtained sub-data is counted.

In the above first embodiment, the standby time in step S170 of FIG. 5 is the time experimentally determined considering the time assumed necessary to dry the ink on the printing paper and the time required till the portion deformed due to the ink moisture is substantially recovered following the drying of ink. However, in step S170, the standby time may be determined by calculation (or experimentally obtained) based on the parameters (such as material) of the printing paper.

In the above first embodiment, the ink amount for determining whether the print state is "heavy-duty" in step S150 of FIG. 6 is modified according to the paper size designated in the paper size designation process of FIG. 7. However, the ink amount for use in this determination may be modified based on the parameters other than the paper size, more particularly, the thickness or the material of the printing paper. In this case, the thickness or the material of the paper instead of the size is selected in step S310 of FIG. 7. The data showing such parameter is stored in the RAM 48. The ink amount "enough to cause deformation" according to the thickness, material of the printing paper is obtained in advance by experiments. In step S150 of FIG. 6, the ink amount "enough to cause deformation" according to the thickness, material indicated in the data stored in the RAM 43 is used for the determination of whether the print state is "heavy-duty". The CPU 41 of the control portion 40 constituted as such can obtain the data showing the thickness or material of the paper in the paper size designation process in FIG. 7. Based on the thickness or material of the paper indicated in the data, whether the print state is "heavy-duty" can be determined.

Moreover, if the print data is the data representing the paper size, the ink amount for use in the determination of whether the print state is "heavy-duty" may be modified according to the paper size indicated in the print data.

Figure 12:
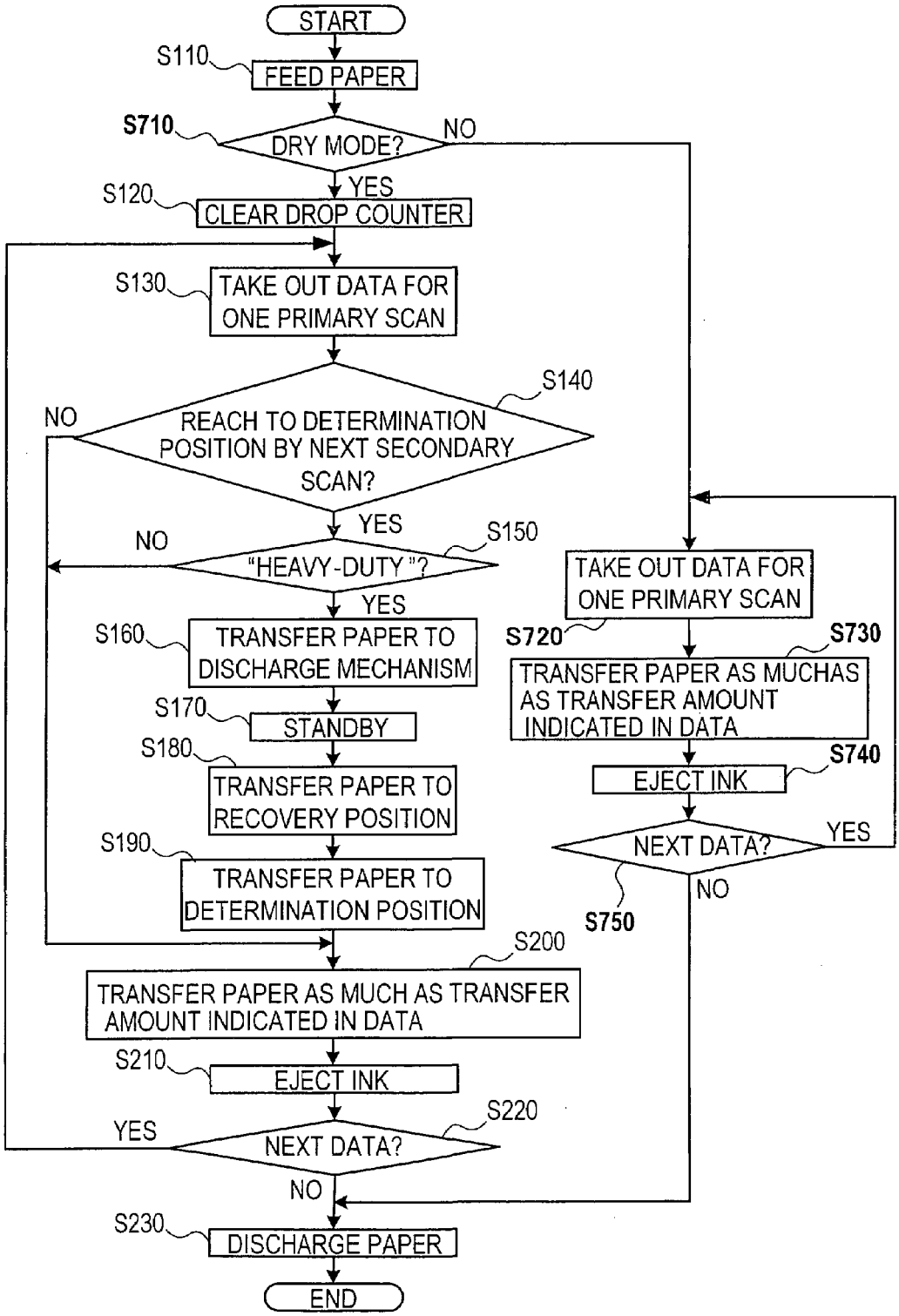
FIG. 12 is a flowchart showing steps of a print process according to another embodiment.

In the above first embodiment, the switching of the modes between the dry mode and the regular mode may be performed in response to the instructions from the outside. In the dry mode, steps S120 and afterward in FIG. 5 are performed to dry the ink on the printing paper. In the regular mode, steps S120 and afterward in FIG. 5 are not executed. In this case, as shown in FIG. 12, the current mode is checked (S710) after step S110. If the current mode is the dry mode (S710: YES), the process proceeds to step S120. If the current mode is the regular mode (S710: NO), the following steps are performed. First, a piece of sub-data is taken out in the same manner as in step S130 (S720). Then, the printing paper is transferred as in step S200 (S730). After the ink is ejected in the same manner as in step S210, whether the next sub-data exists is checked as in step S220.

If the sub-data exists, the process returns to step S720. If no sub-data exists, the print process is ended.

Figure 13:
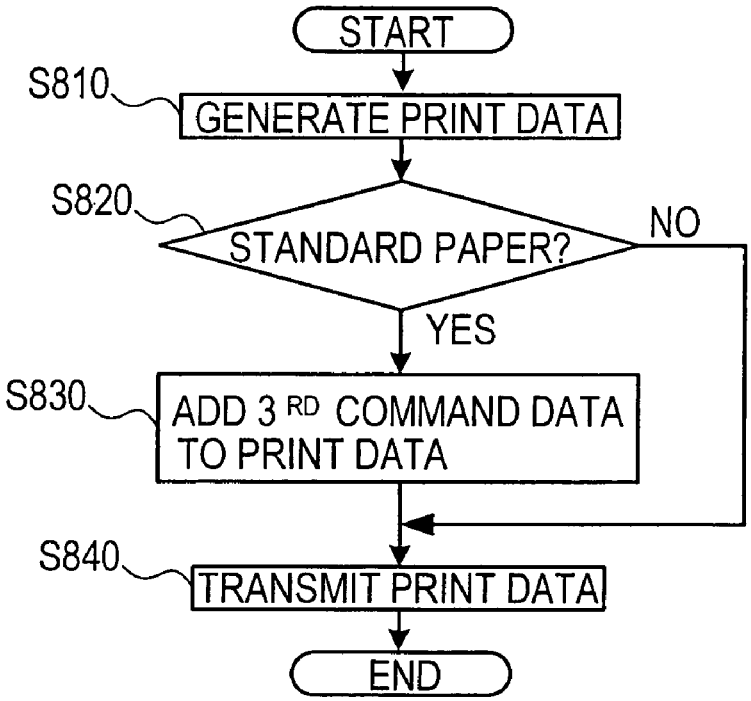
FIG. 13 is a flowchart showing steps of a print data transmission process according to another embodiment.

In order to change modes in the above constitution, it is preferable that the operation keypad 22 of the user I/F 20 is designed to be capable of switching the modes, for example. It is also preferable that, when the print data is transmitted from the PC 100, third command data for selecting the mode may be added to the print data. Particularly, when the print data is transmitted from the PC 100, a print data transmission process as shown in FIG. 13 is performed. Steps in this print data transmission process are processed by a printer driver installed in the PC 100. The print data transmission process is started when prescribed operation for printing an image is carried out in application software running on the PC 100. When such operation is made, not only the image data but also the data representing the paper type to be used for the printing, such as standard paper, OHP (overhead projector) sheet, exclusive glossy paper, are delivered to the printer driver.

First of all, the print data based on the image data is generated (S810). Then the type of the printing paper is checked (S820). In step S820, if the printing paper is the standard paper (S820: YES), the third command data for executing the printing in the dry mode is added to the print data (S830). After step S830, or if it is determined that the printing paper is the OHP sheet or the exclusive glossy paper (S820: NO), the print data is transmitted to the complex apparatus 2 (S840).

What is claimed is:

1. A print system comprising:

a print head that ejects ink;

an upstream transfer device that is provided in a feed path extending from a feed position to a counter area facing the print head, and transfers a recording medium along the feed path;

a downstream transfer device that is provided in a discharge path extending from the counter area to a discharge position, and transfers the recording medium along the discharge path;

a print instruction device that provides instructions for the upstream or downstream transfer device to transfer the recording medium and for the print head to eject ink in turn based on print data representing a predetermined image shown in an ejection pattern of ink to print the image upon the recording medium;

an ink amount measurement device that measures the amount of ink ejected from the print head and stores the amount as a measurement value; and an ink amount determination device that determines whether the measurement value stored in the ink amount measurement device exceeds a preset value when the recording medium is transferred by the upstream transfer device and a front end of the recording medium is moved to a first position, wherein the downstream transfer device is comprised of a drive roller and a driven roller so that the recording medium can be passed through between the drive roller and the driven roller, and the print instruction device discontinues the instructions based on the print data if it is determined by the ink amount determination device that the measurement value exceeds the preset value, and instructs the upstream transfer device to transfer the recording medium from the first position to the downstream transfer device, and when the front end of the recording medium is transferred to the downstream transfer device to be held between the drive roller and the driven roller, further instructs the upstream transfer device to transfer the recording medium to a second position located at least downstream of the first position, the second position being the position where the printing should be performed next to the printing at the first position, so that the instructions based on the print data are continued when the front end of the recording medium has reached to the second position.

2. The print system as set forth in claim 1 wherein said ink amount measurement device measures the amount of ink based on the number of ink drops ejected from the print head.

3. The print system as set forth in claim 1 wherein said print instruction device stands by for a predetermined time in a state that the recording medium is transferred to the downstream transfer device and the front end of the recording medium is held between the drive roller and the driven roller.

4. The print system as set forth in claim 1 wherein said print instruction device, when the recording medium is transferred to the downstream transfer device and the front end of the recording medium is held between the drive roller and the driven roller, instructs the upstream transfer device to transfer the recording medium from the downstream transfer device to a third position which is spaced apart from the first position by a predetermined distance on the side of the feed position, and when the front end of the recording medium is moved to the third position instructs the upstream transfer device to transfer the recording medium from the third position to the first position, so that the instructions based on the print data are resumed, when the front end of the recording medium is moved to the first position.

5. The print system as set forth in claim 1 further comprising a recording medium parameter acquisition device that obtains parameter data representing parameters of the recording medium from the outside, wherein said ink amount determination device modifies a preset value used for the determination of the measurement value according to the parameters shown as the parameter data obtained by the recording medium parameter acquisition device.

6. The print system as set forth in claim 5 further comprising a parameter input device that allows a user to input the parameters of the recording medium, wherein the recording medium parameter acquisition device obtains the parameters inputted from the parameter input device as said parameter data.

7. The print system as set forth in claim 5 wherein said recording medium parameter acquisition device obtains data expressing the size of the recording medium as said parameter data.

8. The print system as set forth in claim 5 wherein said recording medium parameter acquisition device obtains data expressing the thickness of the recording medium as said parameter data.

9. The print system as set forth in claim 5 wherein said recording medium parameter, acquisition device obtains data expressing the material of the recording medium as said parameter data.

10. The print system as set forth in claim 1 further comprising a mode switching device that switches the operation mode of the print system between a suspension mode and a regular mode, in the suspension mode the instructions based on the print data from the print instruction device being interrupted according to the determination result of said ink amount determination device, and in the regular mode the instructions not being interrupted regardless of the determination result of the ink amount determination device.

11. A print system comprising a printer and a terminal apparatus, the printer comprising:

a print head that ejects ink;

an upstream transfer device that is provided in a feed path extending from a feed position to a counter area facing the print head, and transfers a recording medium along the feed path;

a downstream transfer device that is provided in a discharge path extending from the counter area to a discharge position, and transfers the recording medium along the discharge path; and a print instruction device that provides instructions for the upstream or downstream transfer device to transfer the recording medium and for the print head to eject ink in turn based on print data representing a predetermined image shown in an ejection pattern of ink to print the image upon the recording medium, the terminal apparatus comprising:

an ink amount measurement device that measures the amount of ink ejected from the print head and stores the amount as a measurement value; and an ink amount determination device that determines whether the measurement value stored in the ink amount measurement device exceeds a preset value when the recording medium is transferred by the upstream transfer device and a front end of the recording medium is moved to a first position, wherein said printer and said terminal apparatus are communicable to each other for data exchange, the downstream transfer device is comprised of a drive roller and a driven roller so that the recording medium can be passed through between the drive roller and the driven roller, and the print instruction device discontinues the instructions based on the print data if it is determined by the ink amount determination device that the measurement value exceeds the preset value, and instructs the upstream transfer device to transfer the recording medium from the first position to the downstream transfer device, and when the front end of the recording medium is transferred to the downstream transfer device to be held between the drive roller and the driven roller, further instructs the upstream transfer device to transfer the recording medium to a second position located at least downstream of the first position, the second position being the position where the printing should be performed next to the printing at the first position, so that the instructions based on the print data are continued when the front end of the recording medium has reached to the second position.

12. The print system as set forth in claim 11 wherein said printer comprises a recording medium parameter acquisition device that obtains parameter data representing parameters of the recording medium from the outside.

13. The print system as set forth in claim 12 wherein said printer comprises a parameter input device that allows a user to input the parameters of the recording medium.

14. The print system as set forth in claim 11 wherein said printer comprises a mode switching device that switches the operation mode of the print system between a suspension mode and a regular mode, in the suspension mode the instructions based on the print data from the print instruction device being interrupted according to the determination result of said ink amount determination device, and in the regular mode the instructions not being interrupted regardless of the determination result of the ink amount determination device.

15. The print system as set forth in claim 11 wherein said terminal apparatus comprises a recording medium parameter acquisition device that obtains parameter data representing parameters of the recording medium from the outside.

16. The print system as set forth in claim 15 wherein said terminal apparatus comprises a parameter input device that allows a user to input the parameters of the recording medium.

17. The print system as set forth in claim 11 wherein said terminal apparatus comprises a mode switching device that switches the operation mode of the print system between a suspension mode and a regular mode, in the suspension mode the instructions based on the print data from the print instruction device being interrupted according to the determination result of said ink amount determination device, and in the regular mode the instructions not being interrupted regardless of the determination result of the ink amount determination device.

18. A terminal apparatus comprising:

an ink amount measurement device that measures an amount of ink ejected from a print head and stores the amount as a measurement value;

an ink amount determination device that determines whether the measurement value stored in the ink amount measurement device exceeds a preset value when a recording medium is transferred by an upstream transfer device and a front end of the recording medium is moved to a first position; and a mode switching device that switches the operation mode of a print system between a suspension mode and a regular mode, in the suspension mode instructions based on the print data from a print instruction device being interrupted according to determination result of said ink amount determination device, and in the regular mode the instructions not being interrupted regardless of the determination result of the ink amount determination device.

19. The terminal apparatus as set forth in claim 18 further comprising a recording medium parameter acquisition device that obtains parameter data representing parameters of the recording medium from the outside.

20. The terminal apparatus as set forth in claim 18 further comprising a parameter input device that allows a user to input the parameters of the recording medium.

21. A printer comprising:

a print head that ejects ink;

an upstream transfer device that is provided in a feed path extending from a feed position to a counter area facing the print head, and transfers a recording medium along the feed path;

a downstream transfer device that is provided in a discharge path extending from the counter area to a discharge position, and transfers the recording medium along the discharge path; and a print instruction device that provides instructions for the upstream or downstream transfer device to transfer the recording medium and for the print head to eject ink in turn based on print data representing a predetermined image shown in an ejection pattern of ink to print the image upon the recording medium, wherein the downstream transfer device is comprised of a drive roller and a driven roller so that the recording medium can be passed through between the drive roller and the driven roller, and the print instruction device discontinues the instructions based on the print data if it is determined by an ink amount determination device that a measurement value exceeds the preset value, and instructs the upstream transfer device to transfer the recording medium from a first position to the downstream transfer device, and when a front end of the recording medium is transferred to the downstream transfer device to be held between the drive roller and the driven roller, further instructs the upstream transfer device to transfer the recording medium to a second position located at least downstream of the first position, the second position being the position where the printing should be performed next to the printing at the first position, so that the instructions based on the print data are continued when the front end of the recording medium has reached to the second position.

22. The printer as set forth in claim 21 further comprising a recording medium parameter acquisition device that obtains parameter data representing parameters of the recording medium from the outside.

23. The printer as set forth in claim 21 further comprising a parameter input device set that allows a user to input the parameters of the recording medium.

24. The printer as set forth in claim 21 further comprising a mode switching device that switches the operation mode of the print system between a suspension mode and a regular mode, in the suspension mode the instructions based on the print data from the print instruction device being interrupted according to the determination result of said ink amount determination device, and in the regular mode the instructions not being interrupted regardless of the determination result of the ink amount determination device.

25. A print method for a print system comprising a print head that ejects ink, an upstream transfer device that is provided in a feed path extending from a feed position to a counter area facing the print head, and transfers a recording medium along the feed path, and a downstream transfer device that is provided in a discharge path extending from the counter area to a discharge position, and transfers the recording medium along the discharge path, the downstream transfer device being comprised of a drive roller and a driven roller, so that the recording medium is passed through between the drive roller and the driven roller, a predetermined image being printed onto the recording medium when transfer of the recording medium to the upstream or downstream transfer device and ink ejection from the print head are instructed in turn based on print data representing the image shown in an ejection pattern of ink, the method comprising steps of:

measuring the amount of ink ejected from the print head and storing the amount as a measurement value;

determining whether the measurement value stored in the ink amount measurement device exceeds a preset value when the recording medium is transferred by the upstream transfer device and a front end of the recording medium is moved to a first position; and discontinuing the instructions based on the print data if it is determined that the measurement value exceeds the preset value, and instructing the upstream transfer device to transfer the recording medium from the first position to the downstream transfer device, and when the recording medium is transferred to the downstream transfer device to be held between the drive roller and the driven roller, further instructing the upstream transfer device to transfer the recording medium to a second position located at least downstream of the first position, the second position being the position where the printing should be performed next to the printing at the first position, so that the instructions based on the print data are continued when the front end of the recording medium has reached to the second position.

26. A computer-readable medium having computer-readable instructions, the instructions comprising:

instructions for a print instruction device to provide instructions for an upstream or downstream transfer device to transfer a recording medium and for a print head to eject ink in turn based on print data representing a predetermined image shown in an ejection pattern of ink to print the image upon the recording medium;

instructions for an ink amount measurement device to measure the amount of ink ejected from the print head and stores the amount as a measurement value; and instructions for an ink amount determination device to determine whether the measurement value stored in the ink amount measurement device exceeds a preset value when the recording medium is transferred by the upstream transfer device and a front end of the recording medium is moved to a first position, wherein the downstream transfer device is comprised of a drive roller and a driven roller so that the recording medium can be passed through between the drive roller and the driven roller, and the print instruction device discontinues the instructions based on the print data if it is determined by the ink amount determination device that the measurement value exceeds the preset value, and instructs the upstream transfer device to transfer the recording medium from the first position to the downstream transfer device, and when the front end of the recording medium is transferred to the downstream transfer device to be held between the drive roller and the driven roller, further instructs the upstream transfer device to transfer the recording medium to a second position located at least downstream of the first position, the second position being the position where the printing should be performed next to the printing at the first position, so that the instructions based on the print data are continued when the front end of the recording medium has reached to the second position.

* * * * *